US005974671A

United States Patent [19]

Dunn

[11] Patent Number: 5,974,671

[45] Date of Patent: Nov. 2, 1999

[54] CUTTING GUIDE ATTACHMENT FOR AN ELECTRIC KNIFE

[76] Inventor: Norris J. Dunn, Rte. 5 Box 4090 Hwy. 94, Lufkin, Tex. 75904-9312

[21] Appl. No.: 09/118,074

[22] Filed: Jul. 16, 1998

[51] Int. Cl.[6] ..... B26B 3/03

[52] U.S. Cl. ..... 30/283; 30/293

[58] Field of Search ..... 30/282, 283, 284, 30/285, 286, 289, 293

[56] References Cited

U.S. PATENT DOCUMENTS

| | | | |
|---|---|---|---|
| 605,944 | 6/1898 | Wright | 30/283 |
| 775,601 | 11/1904 | Goldstein | 30/283 |
| 1,436,811 | 11/1922 | Lien | 30/283 |
| 5,575,070 | 11/1996 | Anderson | 30/283 |

FOREIGN PATENT DOCUMENTS

| | | | |
|---|---|---|---|
| 503573 | 6/1951 | Belgium | 30/283 |
| 218736 | 2/1910 | Germany | 30/283 |

*Primary Examiner*—Hwel-Siu Payer

[57] ABSTRACT

A cutting guide attachment for an electric knife including a plastic housing having an inboard portion for attaching the handle to an electric knife. It also includes an outboard portion operatively positioned to the reciprocating blades of the electric knife. The housing has first inverted U-shaped fingers ascending downwardly from the end of the outboard portion of the housing and second inverted U-shaped fingers extending downwardly from an intermediate region of the outboard portion of the housing. The first and second fingers have exterior arcuate recesses on one face thereof. A plurality of rollers is included having varying sizes positionable in nesting relationship one within the other. The interiormost roller has an extended length to be received within the recesses, whereby any number of nested rollers may be received upon the innermost roller for providing a surface of a predetermined diameter for rolling across the food to be sliced.

7 Claims, 3 Drawing Sheets

FIG 1
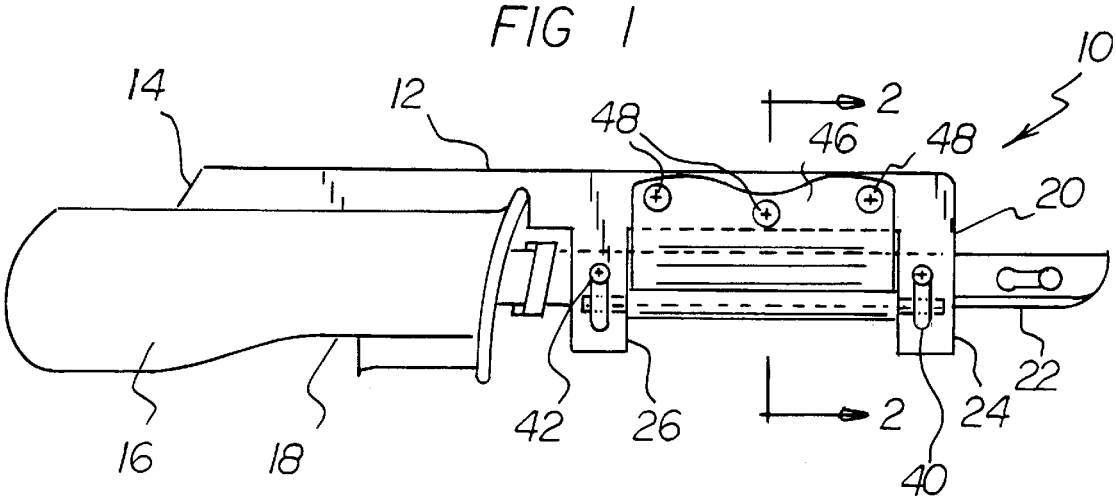
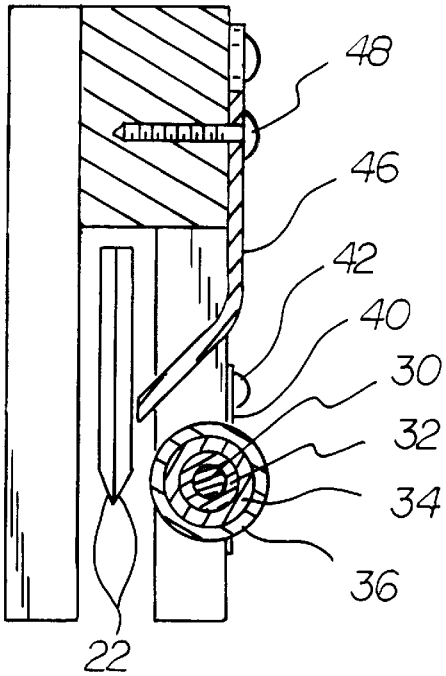
FIG 2

FIG 3
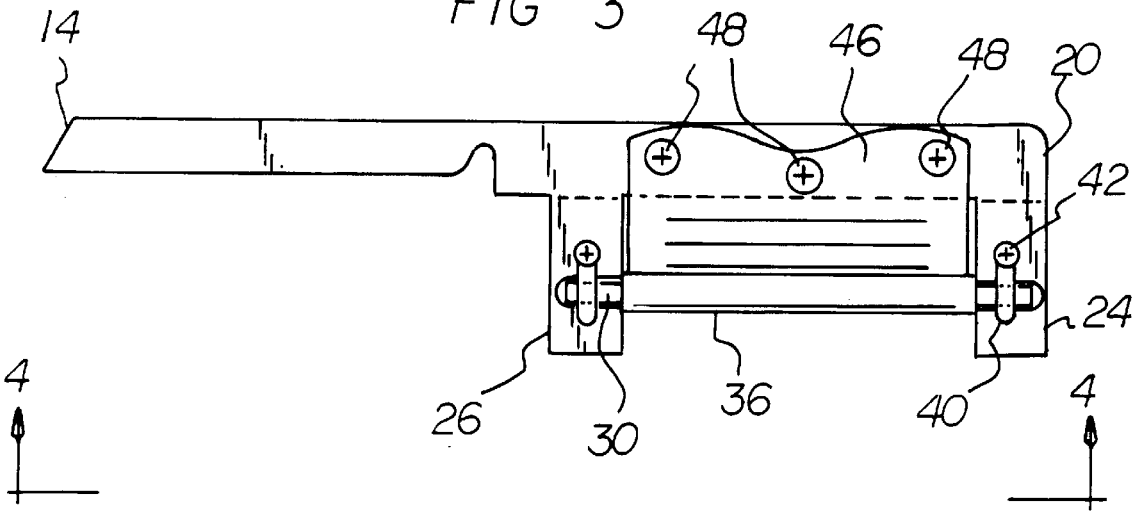
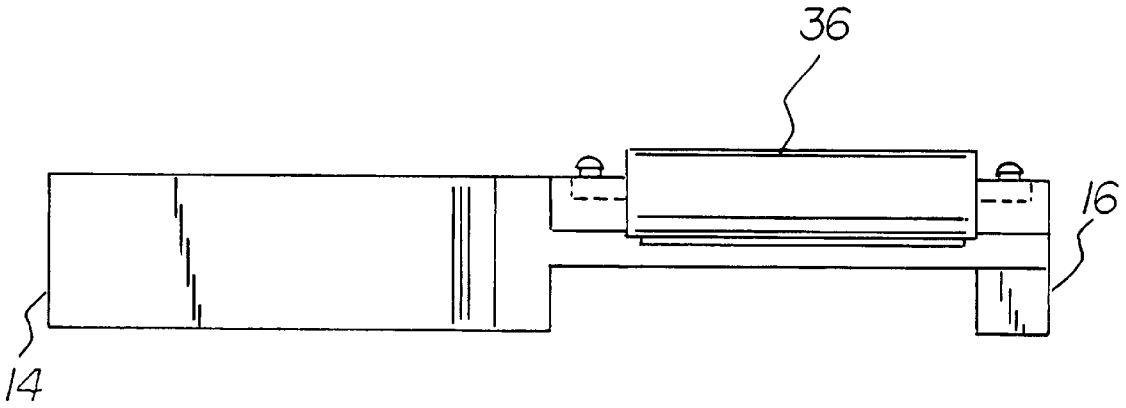
FIG 4

CUTTING GUIDE ATTACHMENT FOR AN ELECTRIC KNIFE

BACKGROUND OF THE INVENTION

1. Field of the Invention

The present invention relates to a cutting guide attachment for an electric knife and more particularly pertains to ensuring the cutting of foods to a predetermined thickness.

2. Description of the Prior Art

The use of kitchen tools of various designs and configurations is known in the prior art. More specifically, kitchen tools of various designs and configurations heretofore devised and utilized for the purpose of slicing objects by various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,981,078 to Alberti discloses an Electric Knife With Guide Blade. U.S. Pat. No. 3,178,817 to Rubinstein discloses Cutting Implements. U.S. Pat. No. 5,598,759 to Sie et al. discloses Food Slicing Rack Devices. U.S. Pat. No. 3,153,852 to Freeman discloses a Blade Connection Means for Power-Operated Slicing Knife. U.S. Pat. No. 4,204,451 to Reichert discloses a Cutting Block Employing Cuttable Rods. Lastly, U.S. Pat. No. Des. 371,728 to Krueger discloses a Bagel Cutter Guide.

While these devices fulfill their respective, particular objectives and requirements, the aforementioned patents do not describe an cutting guide attachment for an electric knife that allows the slicing of objects at a predetermined thickness.

In this respect, the cutting guide attachment for an electric knife according to the present invention substantially departs from the conventional concepts and designs of the prior art, and in doing so provides an apparatus primarily developed for the purpose of to ensure the cutting of foods to a predetermined thickness.

Therefore, it can be appreciated that there exists a continuing need for a new and improved cutting guide attachment for an electric knife which can be used for to ensure the cutting of foods to a predetermined thickness. In this regard, the present invention substantially fulfills this need.

SUMMARY OF THE INVENTION

In view of the foregoing disadvantages inherent in the known types of kitchen tools of various designs and configurations now present in the prior art, the present invention provides an improved cutting guide attachment for an electric knife. As such, the general purpose of the present invention, which will be described subsequently in greater detail, is to provide a new and improved cutting guide attachment for an electric knife and method which has all the advantages of the prior art and none of the disadvantages.

To attain this, the present invention essentially comprises an cutting guide attachment for an electric knife to ensure the cutting of foods to a predetermined thickness including a housing having an inboard portion for attaching the handle to an electric knife. The system also includes an outboard portion operatively positioned to the reciprocating blades of the electric knife. The housing has first inverted U-shaped fingers ascending downwardly from the end of the outboard portion of the housing and second inverted U-shaped fingers extending downwardly from an intermediate region of the outboard portion of the housing. The first and second fingers having exterior arcuate recesses on one face thereof. Also provided is a plurality of rollers of varying sizes positionable in nesting relationship one within the other. The interiormost roller has an extended length to be received within the recesses, whereby any number of nested rollers may be received upon the innermost roller for providing a surface of a predetermined diameter for rolling across the food to be sliced. Also included is a keeper plate with screws removably coupled to the housing to retain the innermost roller within the recesses. A guide plate is provided with screws for selectively coupling to the housing between the first and second U-shaped fingers with an inturned lower end for facilitating the sliding of the knife through the food to be sliced.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cutting guide attachment for an electric knife which has all of the advantages of the prior art kitchen tools of various designs and configurations and none of the disadvantages.

It is another object of the present invention to provide a new and improved cutting guide attachment for an electric knife which may be easily and efficiently manufactured and marketed.

It is further object of the present invention to provide a new and improved cutting guide attachment for an electric knife which is of durable and reliable constructions.

An even further object of the present invention is to provide a new and improved cutting guide attachment for an electric knife which is susceptible of a low cost of manufacture with regard to both materials and labor, and which accordingly is then susceptible of low prices of sale to the consuming public, thereby making such cutting guide attachment for an electric knife economically available to the buying public.

Even still another object of the present invention is to provide an cutting guide attachment for an electric knife for to ensure the cutting of foods to a predetermined thickness.

Lastly, it is an object of the present invention to provide a new and improved cutting guide attachment for an electric knife including a plastic housing having an inboard portion for attaching the handle to an electric knife. The system also includes an outboard portion operatively positioned to the reciprocating blades of the electric knife. The housing has first inverted U-shaped fingers ascending downwardly from the end of the outboard portion of the housing and second inverted U-shaped fingers extending downwardly from an intermediate region of the outboard portion of the housing. The first and second fingers have exterior arcuate recesses on one face thereof. A plurality of rollers is included having varying sizes positionable in nesting relationship one within the other. The interiormost roller has an extended length to be received within the recesses, whereby any number of nested rollers may be received upon the innermost roller for providing a surface of a predetermined diameter for rolling across the food to be sliced.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of the preferred embodiment of the cutting guide attachment for an electric knife constructed in accordance with the principles of the present invention.

FIG. 2 is a cross-sectional view taken along line 2—2 of FIG. 1.

FIG. 3 is a front elevational view similar to FIG. 1 but with the knife removed.

FIG. 4 is a top elevational view of the device shown in the prior Figure.

The same reference numerals refer to the same parts through the various Figures.

DESCRIPTION OF THE PREFERRED EMBODIMENT

Figure 5:
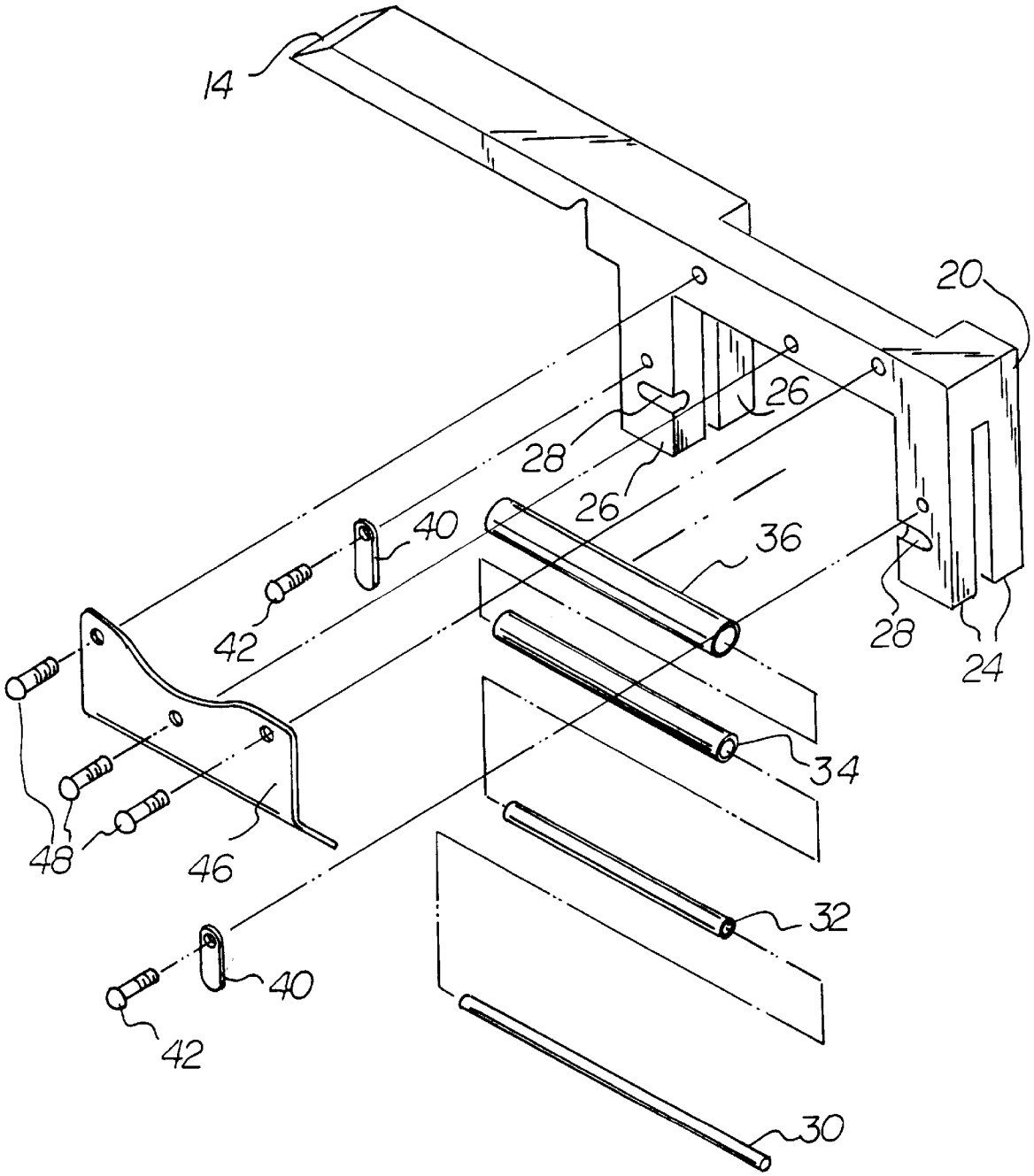
FIG. 5 is an exploded perspective view of the device shown in the prior Figures.

With reference now to the drawings, and in particular to FIG. 1 thereof, the preferred embodiment of the new and improved cutting guide attachment for an electric knife embodying the principles and concepts of the present invention and generally designated by the reference numeral 10 will be described.

The present invention, the cutting guide attachment for an electric knife 10 is comprised of a plurality of components. Such components are individually configured and correlated with respect to each other so as to attain the desired objective.

More specifically, the system includes a housing 12 having an inboard portion 14 for attaching the handle 16 to an electric knife 18. The system also includes an outboard portion 20 operatively positioned to the reciprocating blades 22 of the electric knife. The housing has first inverted U-shaped fingers 24 ascending downwardly from the end of the outboard portion of the housing and second inverted U-shaped fingers 26 extending downwardly from an intermediate region of the outboard portion of the housing, the first and second fingers having exterior arcuate recesses 28 on one face thereof.

Also provided is a plurality of rollers 30, 32, 34, 36 of varying sizes positionable in nesting relationship one within the other. The interiormost roller 30 has an extended length to be received within the recesses 28, whereby any number of nested rollers may be received upon the innermost roller for providing a surface of a predetermined diameter for rolling across the food to be sliced.

A keeper plate 40 is provided with screws 42 removably coupled to the housing to retain the innermost roller 30 within the recesses 28.

Lastly provided is a guide plate 46 with screws 48 for selectively coupling to the housing between the first and second U-shaped fingers with an inturned lower end for facilitating the sliding of the knife through the food to be sliced.

As described hereinabove, the invention of the present system enables it easier for one to evenly slice food at a predetermined thickness.

The system includes a plastic gauge attachment with three interchangeable, stainless steel rollers mounted thereto. The system features a snap-on handle for ease in attachment to the handle of an electric knife. The gauge rests directly on top of the knife, and the tube is placed below the knife. The system provides uniform cuts of bread, meat, vegetables, and other food products, and the thickness of the slice varies depending on the type of tube utilized. The system is easily produced from plastic and in a wide variety of colors and styles to match the decor of any kitchen.

The appealing features of the system is its convenience, durability, ease of use, timesavings, practicality, and effectiveness. This system provides the user with greater flexibility and maneuverability while slicing foods. With a firm grip on the handle, one is able to easily and quickly cut foods and to vary the thickness of the slices depending upon the type of tube used.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cutting guide attachment for an electric knife to ensure the cutting of foods to a predetermined thickness comprising:

a housing having an inboard portion for attaching the housing to an electric knife and an outboard portion positioned to reciprocating blades of the electric knife, the housing having first inverted U-shaped fingers ascending downwardly from an end of the outboard portion of the housing and second inverted U-shaped fingers extending downwardly from an intermediate region of the outboard portion of the housing, the first and second fingers having exterior arcuate recesses on one face thereof;

a plurality of rollers of varying sizes positionable in nesting relationship one within the other, with the innermost roller having an extended length to be received within the recesses, whereby any number of nested rollers may be received upon the innermost roller for providing a surface of a predetermined diameter for rolling across the food to be sliced;

keeper plates with screws removably coupled to the housing to retain the innermost roller within the recesses; and a guide plate with screws for selectively coupling to the housing between the first and second inverted U-shaped fingers with an inturned lower end for facilitating the sliding of the knife through the food to be sliced.

2. A cutting guide attachment for an electric knife comprising:

a plastic housing having an inboard portion for attaching to the housing to an electric knife and an outboard portion operatively positioned to reciprocating blades of the electric knife, the housing having first inverted U-shaped fingers ascending downwardly from an end of the outboard portion of the housing and second inverted U-shaped fingers extending downwardly from an intermediate region of the outboard portion of the housing, the first and second fingers having exterior arcuate recesses on one face thereof; and a plurality of rollers of varying sizes positionable in nesting relationship one within the other, with the innermost roller having an extended length to be received within the recesses, whereby any number of nested rollers may be received upon the innermost roller for providing a surface of a predetermined diameter for rolling across the food to be sliced.

3. The attachment as set forth in claim 2 and further including keeper plates with screws removably coupled to the housing to retain the innermost roller within the recesses.

4. The attachment as set forth in claim 2 and further including a guide plate with screws for selectively coupling to the housing between the first and second inverted U-shaped fingers with an inturned lower end for facilitating the sliding of the knife through the food to be sliced.

5. The attachment of claim 4, wherein the guide plate has a generally planar upper portion adjacent the inturned lower end of the guide plate, wherein the inturned lower end of the guide plate is extended at an obtuse angle from the generally planar upper portion of the guide plate.

6. The attachment of claim 4, wherein the inturned lower end of the guide plate terminates along a generally straight lower edge of the guide plate.

7. The attachment of claim 2, wherein the plurality of rollers in the nesting relationship comprises first, second, third, and four rollers.

* * * * *